US007828025B2

(12) United States Patent
McBride et al.

(10) Patent No.: US 7,828,025 B2
(45) Date of Patent: Nov. 9, 2010

(54) APPARATUS FOR CLEANING A WOOD CHIPPER

(75) Inventors: Daniel R. McBride, Carthage, NY (US); Jamie Hunter, Traralgon (AU)

(73) Assignee: CEM Machine, Inc., Carthage, NY (US)

( * ) Notice: Subject to any disclaimer, the term of this patent is extended or adjusted under 35 U.S.C. 154(b) by 156 days.

(21) Appl. No.: 12/185,352

(22) Filed: Aug. 4, 2008

(65) Prior Publication Data

US 2010/0024922 A1 Feb. 4, 2010

(51) Int. Cl.
*B02C 7/00* (2006.01)

(52) U.S. Cl. ..... 144/162.1; 241/285.2; 241/285.3

(58) Field of Classification Search ..... 144/162.1, 144/172–174, 176; 241/285.2, 285.3
See application file for complete search history.

(56) References Cited

U.S. PATENT DOCUMENTS 426,946 A * 4/1890 Merrill ..... 241/55
4,784,337 A * 11/1988 Nettles et al. ..... 241/92
5,139,063 A * 8/1992 Nettles et al. ..... 144/176
6,016,855 A 1/2000 Morey
6,755,772 B2 6/2004 Pallmann
6,767,315 B2 7/2004 Pallmann
7,134,463 B2 * 11/2006 Pallmann ..... 144/162.1

* cited by examiner

*Primary Examiner*—Shelley Self
(74) *Attorney, Agent, or Firm*—Hiscock & Barclay, LLP

(57) ABSTRACT

Apparatus for limiting the amount of debris that is disbursed in and around a disc type wood chipper when the disc is being treated with high pressure air. The apparatus includes a casing that surrounds the chipper disc having a stationary section and a removable section that can be detached from the stationary section to provide access to about 90° of the disc. A shield is hinged to the stationary section of the disc that has a vertical wall and an arcuate cover that can be moved over the exposed section of the disc which contains and directs debris in the chippers exhaust system when removed by high pressure air that is directed at the front face of the disc.

8 Claims, 5 Drawing Sheets

APPARATUS FOR CLEANING A WOOD CHIPPER

FIELD OF THE INVENTION

This invention relates generally to large disc type wood chippers and in particular to removal of debris from large disc type wood chippers.

BACKGROUND OF THE INVENTION

This invention relates more specifically to the removal of wood particles, dirt, dust and debris from a large disc type wood chipper during the period the machine is undergoing a knife blade replacement procedure. Typically, in most large disc type chippers, a series of slots are passed through the disc and cutting blades are mounted at the front face entrance of the slots. Logs are fed into the machine so that they move in contact with the front face of the rotating disc where they come in contact with the knife blades. Chips are removed from the logs by the blades and are directed through the slots into a discharge chute that is located behind or under the disc. With time, the knife blades become dull and must be replaced with new or resharpened blades.

During the blade replacement procedure, a section of the machine casing that surrounds the disc is removed to provide access to a portion of the disc in the exposed region. The blades in this region are removed from the disc and new blades are installed, typically by a person on the front side of the disc, while a second person is often required also on the back side of the disc to conduct other disc chipper maintenance or to loosen clamps that hold the blades onto the front of the disc, and the disc is rotated in steps through the exposed region until such time as blades in all the slots are changed. A considerable amount of debris produced during the chipping operation is left behind which must be removed from the machine before replacement blades are installed. The unwanted material that is left behind is generally tightly packed in the disc slots and caked upon the machine surfaces and requires among other things such as mechanical scraping and the application of high pressure air to dislodge it and clear it away from the machine. This, in turn, causes a great deal of dirt, dust and the like to be broadcast about the machine location which is difficult and time consuming to contain and clean up. In addition, these airborne particles can cause an eye injury or be inhaled by those working in the area and thus create a potential health hazard.

Attempts have been made to contain and clean up the debris created during the blade replacing procedure using such techniques as vacuuming but for the most part have met with little success or are far less efficient and are more time consuming than using high pressure air.

SUMMARY OF THE INVENTION

It is therefore a primary object of the present invention to improve disc type wood chippers.

A further object of the invention is to provide apparatus for improving the containment and removal of unwanted debris from a wood chipping machine.

A still further object of the invention is to shorten the time required to remove unwanted debris from a wood chipping machine.

Another object of the invention is to limit the amount of fine debris in and around a disc type chipper during the time such debris is being removed from a wood chipping machine.

These and other objects are attained in a wood chipper that contains a rotatable disc that has a series of slots formed in the disc that are equipped with knife blades at the entrances to the slots. A casing enclosing the disc has a detachable section that permits free access to a portion of the disc when it is removed from the stationary section so that the blades can be removed from the slots and unwanted debris dislodged from the disc as the disc is indexed in steps through the access region. An auxiliary shield is hinged to the stationary section of the casing adjacent to the access region which can be brought over the back portion and outer rim of the disc that is located in the access region. The cover serves to contain and direct debris removed from the disc by high pressure air into a discharge chute of the machine where it us further conducted out of the machine under more quiescent conditions.

BRIEF DESCRIPTION OF THE DRAWINGS

For a better understanding of these and other objects of the present invention reference will be made to the following detailed description of the invention which is to be read in association with the accompanying drawings, wherein.

DETAILED DESCRIPTION

Figure 1:
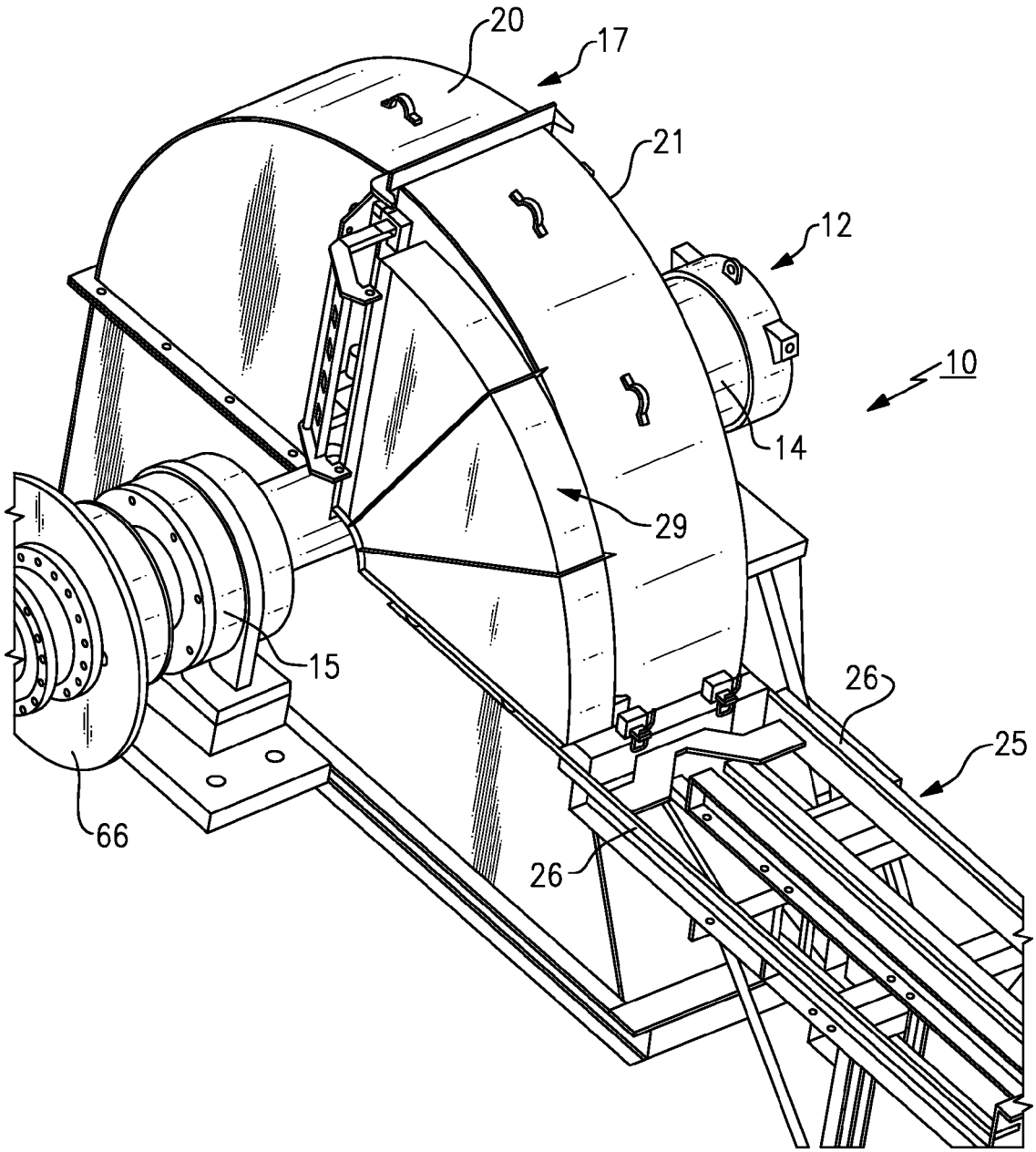
FIG. 1 is a rear perspective view of a wood chipper that embodies the present invention showing the chipper substantially enclosed by a protective casing and having an auxiliary shield mounted thereon in a stored position.

Turning initially to FIGS. 1-4 there is shown a disc type wood chipper, generally referenced 10, that embodies the teachings of the present invention. As is well known in the art a rotatable disc 16 is mounted upon a horizontally disposed shaft assembly 12 with shaft 13 being supported in bearing blocks 14 and 15. The shaft is connected to a high speed motor (not shown) by means of a coupling 66. The disc 16 is surrounded by a protective casing 17 that includes a stationary section 20 and a removable section 21 that is detachably connected to the stationary section by means of a series of mounting flanges such as flange 23. The removable casing section 21 is slidably supported upon a rail system 25 by a series of slides 26-26 that permit the removable section to be moved horizontally out of the way to provide a clear access area 28 that exposes about one quarter of the disc.

During periodic maintenance, the knife blades that are carried in slots 60 (FIG. 4) formed in the disc 16, are typically removed and replaced with new blades or refurbished blades. Personnel are often required at both the front and back sides of the disc to accomplish this. At this time, debris that has been built-up in and around the disc is also dislodged from the machine surfaces and blown clear of the machine surfaces using high pressure air. Accordingly, the airborne particles which are heavy in dust, dirt and wood fragments are broadcast over a wide area of the shop in which the machine is situated. Because of the nature of this material, housecleaning of the contaminated area is generally difficult and time consuming to accomplish. Additionally, the airborne particles can cause skin or eye injuries and can be easily inhaled by nearby workers thus posing a potential health hazard to those working in or near the broadcast region.

As shown in greater detail in FIGS. 1-4, an auxiliary shield, generally reference 29 is hinged to the stationary section 20 of the casing on the rear side of the casing by means of a compound hinge 30. The shield contains a vertical wall 32 that generally compliments the rear wall geometry of the removable section 21 of the casing and an arcuate shaped top panel 33. The top panel 33 runs generally perpendicular to the vertical wall 32 and as will be explained in further detail below, the shield can be moved to a protective or closed positioning with regard to the chipper disc when the removable section of the casing is moved back to provide access Region 28. Preferably the shield is fabricated of metal or a high strength plastic material.

Figure 2:
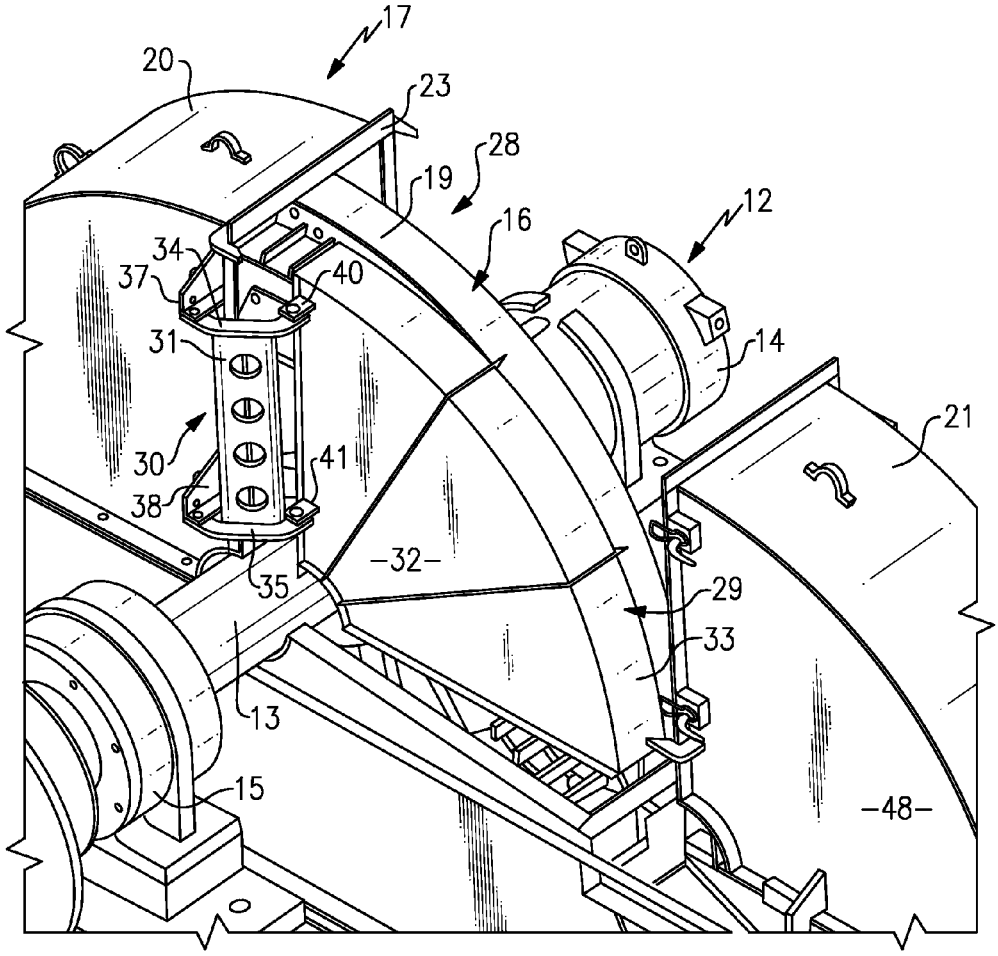
FIG. 2 is a slightly enlarged partial rear perspective view of the chipper showing the removable section of the detachable casing moved back from the stationary section of the casing and the shield placed in a closed position about the exposed section of the disc.

As illustrated in FIG. 1, the compound hinge 30 enables the shield 28 to be closed against the back wall of the removable casing section when this section is attached to the stationary casing section. The compound hinge 30 includes a rectangular plate 31 that has a top flange 34 and a bottom flange 35. The flanges extend outwardly beyond the right and left vertical edges of the plate. As best seen in FIG. 2, the left side of the top and bottom flanges are pivotably connected to a top bracket 37 and a bottom bracket 38 that are secured to the stationary casing section adjacent to the access region 28 that is made available when the section 21 of the casing is moved back along the rail system. The opposite or right hand side of the top and bottom flanges are similarly pivotably connected to top and bottom tabs 40 and 41 respectively which are secured to the vertical wall 32 of the shield.

Figure 3:
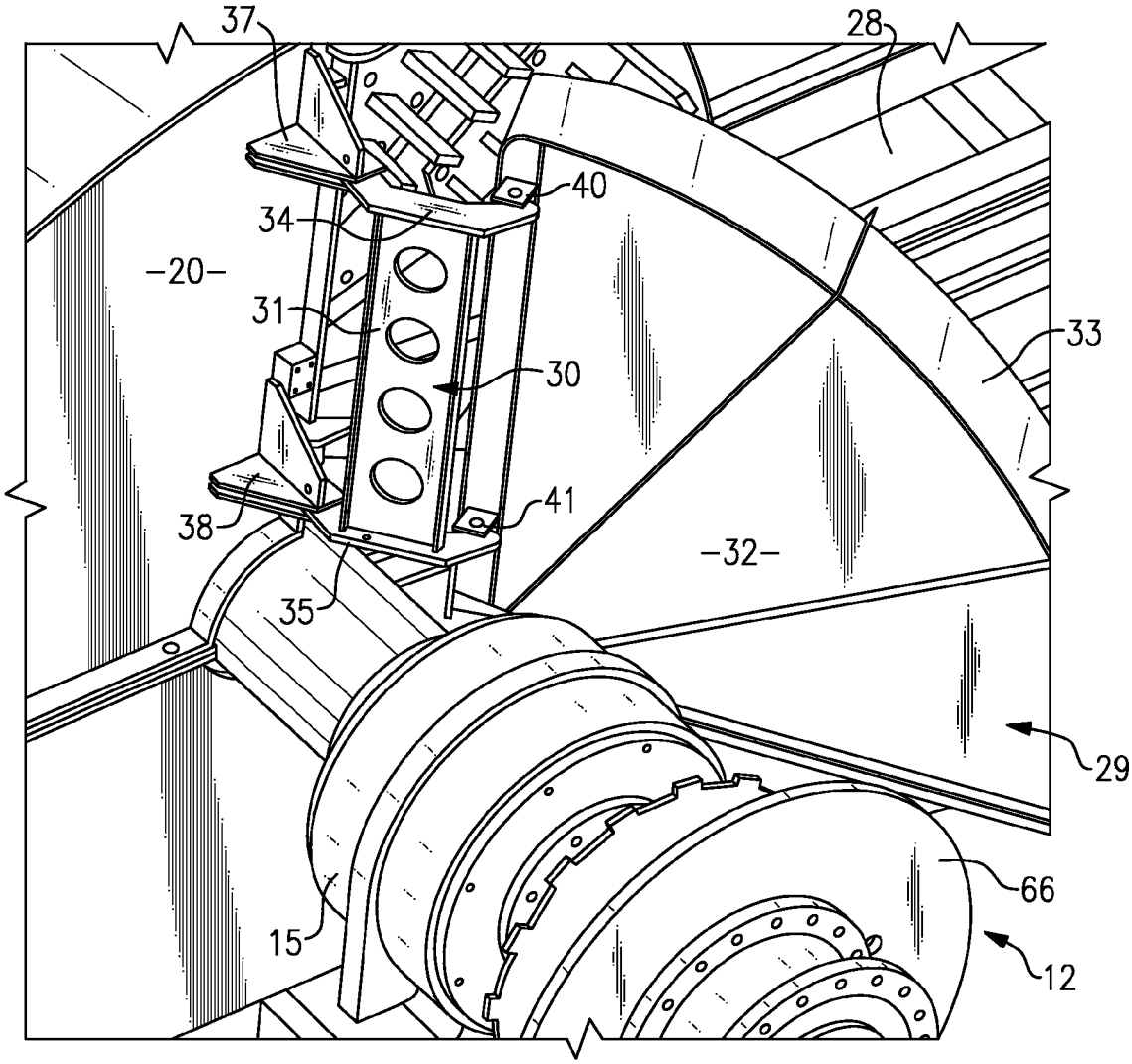
FIG. 3 is a partial rear perspective view of the chipper showing the removable casing section detached from the stationary section and the shield shown in an open position.

As can be seen, the compound hinge provides the shield with a wide range of movement. As illustrated in FIG. 2, with the casing section 21 moved back along the rails the shield can be pivoted into the access region into a closed position wherein the vertical wall 32 of the shield brought into parallel alignment with the back face of the chipper disc 16 and the top panel 33 of the shield is located over the outer rim 19 of the disc 16. This shield position will be herein referred to as the closed shield position. FIG. 3, which is a partial rear perspective view of the access region 28, showing the shield pivoted back away from the access region to a fully opened position in which free access is provided to both the front face and the back face of the disc.

Figure 5:
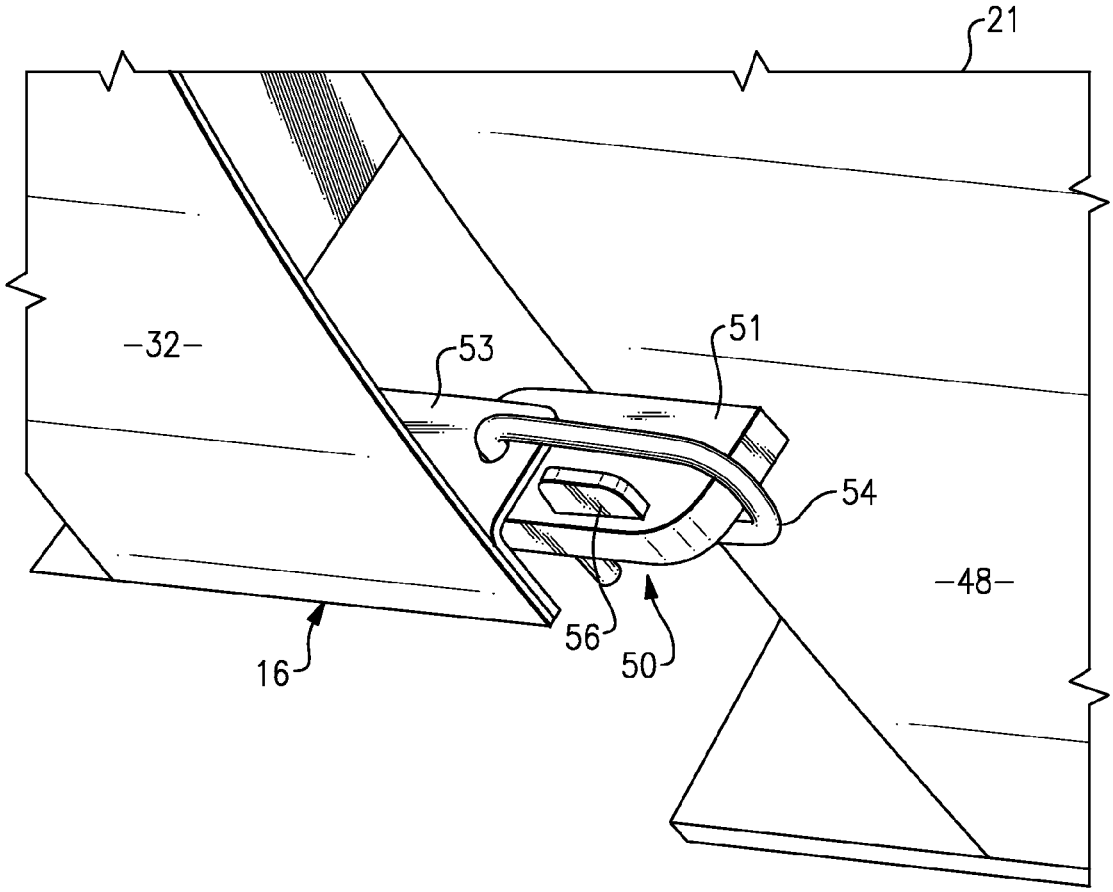
FIG. 5 is an enlarged perspective view showing a latch mechanism for holding the auxiliary shield in the stored position against the removable casing section.

FIG. 1 shows the removable section of the casing attached to the stationary section of the casing. At this time, the compound hinge 30 allows the shield to be moved into a stored position in contact against the back wall 48 of the removable casing section. As best seen in FIG. 5, a latching mechanism 50 is furnished to secure the shield against the rear wall of the removable casing section. The latching mechanism includes a lug 51 that is secured, as for example by welding, to the back wall 48 of the removable casing section 21. The lug is arranged to slide under a co-acting L-shaped bracket 53 that is attached to the inside of vertical wall 32 of the shield. A C-shaped hasp 54 is pivotably supported within the bracket which can swing over the lug when the shield is closed against the removable casing. An inverted L-shaped locking key 56 is slidably received within a hole provided in the lug which serves to prevent the hasp from being released thus securing the shield in the noted stored position.

Figure 4:
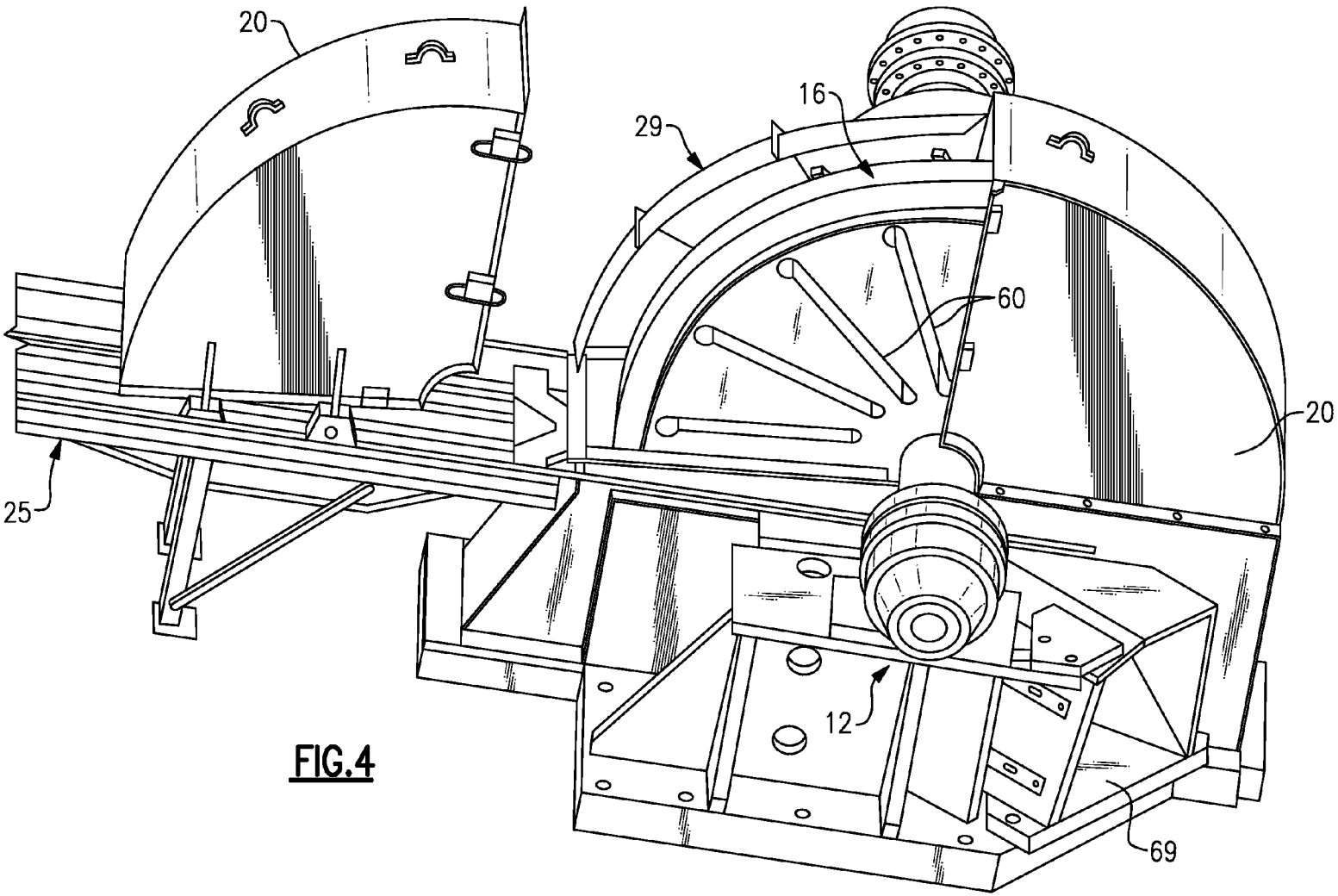
FIG. 4 is a front perspective view of the wood chipper with the removable casing section detached and the auxiliary shield closed over the exposed section of the disc.

FIG. 4 illustrates the front of the chipper in further detail with the removable section of the casing moved back along the rails to expose a quarter section of the disc within the access region.

As noted above, the disc 16 contains a series of radially extended slots 60-60 that normally house knife blades at the entrance to the slots which perform the chipping operation. The slots in FIG. 4 are shown with the blade removed and, the shield is shown in the closed position about the exposed quarter section of the disc. The machine is now in a configuration in which debris that has been dislodged from the machine surfaces can be safely and clearly disposed of. At this time high pressure air is delivered at the exposed portions of the machine in the unshielded front part of the access region. The dislodged debris is driven by the air back against the shield which conducts the debris downwardly into the sump of the machine where it is collected. Once the initial quarter section of the disc is cleaned, the disc is indexed in angular increments until such time as the machine is thoroughly cleaned. The blades are then replaced and the casing closed and the machine is started up. This causes the collected debris in the sump or chip discharge chute 69 that is located within the lower section of the casing where it is removed with the chips when the machine is put back into production.

While the invention has been described with reference to a preferred embodiment, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. Apparatus for minimizing the amount of debris that is distributed in and around a disc type wood chipper during the period the chipper is undergoing a cleaning procedure for removal of debris, wherein said apparatus includes:

a casing for substantially enclosing a disc and having a chip discharge chute located in the bottom of said casing;

said casing further including a stationary section and a removable section that is detachably connected to said stationary section to provide an access region for exposing a front face portion and back face portion of said disc when said removable section is detached;

an auxiliary shield enclosing the back face portion and outer rim of said disc as situated within the access region;

support means for movably supporting said auxiliary shield upon the back of said stationary section of said casing so that said auxiliary shield can move between:

a first stored position against the back of said removable section of said casing when said removable section is attached to said stationary section of said casing;

a second open position when said removable section is detached from said stationary section of said casing to provide full access to the exposed portions of said disc in the access region; and a third closed position when said removable section is detached from said stationary section of said casing wherein said shield encloses the back face and the outer rim of the disc that is exposed in the access region whereby debris removed from the disc is directed by said shield into the chip discharge chute of said chipper.

2. The apparatus of claim 1, wherein said support means includes a hinge mechanism for movably supporting said auxiliary shield.

3. The apparatus of claim 1, wherein said support means is a compound hinge that includes a plate having one vertical edge that is hinged to said stationary section of said casing and an opposed vertical edge that is hinged to said auxiliary shield.

4. The apparatus of claim 1, that further includes a latching mechanism for removably securing said auxiliary shield to said removable section of said casing when said removable section is attached to said stationary section of said casing.

5. The apparatus of claim 1, wherein said auxiliary shield is fabricated of metal.

6. The apparatus of claim 1, wherein said auxiliary shield is fabricated of plastic.

7. The apparatus of claim 4, wherein said latching mechanism contains a hasp mounted upon said auxiliary shield which engages a lug mounted upon said removable section of said casing and a key that is insertable in said lug.

8. The apparatus of claim 1, wherein said access region encompasses about 90° of said disc.

* * * * *